US006544133B2

(12) United States Patent
Ou

(10) Patent No.: US 6,544,133 B2
(45) **Date of Patent: *Apr. 8, 2003**

(54) INFLATABLE SPORTSBALL WITH CUSHION LAYER

(76) Inventor: Tsung Ming Ou, No. 32, Lane 56, Chung Cheng 2nd Road, Kaohsiung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/093,809

(22) Filed: Mar. 11, 2002

(65) Prior Publication Data

US 2002/0098928 A1 Jul. 25, 2002

Related U.S. Application Data

(62) Division of application No. 09/767,310, filed on Jan. 22, 2001.

(51) Int. Cl.[7] ..... A63B 41/08
(52) U.S. Cl. ..... 473/604; 473/605
(58) Field of Search ..... 473/599, 603, 473/604, 605, 597, 598, 607

(56) References Cited

U.S. PATENT DOCUMENTS 3,508,750 A * 4/1970 Henderson ..... 473/605
5,681,233 A * 10/1997 Guenther et al. ..... 473/604
5,931,752 A * 8/1999 Guenther et al. ..... 473/597
6,022,283 A * 2/2000 Schindler et al. ..... 473/605
6,099,423 A * 8/2000 Ou ..... 473/604
6,206,795 B1 * 3/2001 Ou ..... 473/599

* cited by examiner

*Primary Examiner*—Steven Wong
(74) *Attorney, Agent, or Firm*—Raymond Y. Chan; David and Raymond Patent Group

(57) ABSTRACT

An inflatable sportsball with cushion layer includes an inflatable ball carcass defining a shape of the sportsball and a ball cover for covering the ball carcass to provide uniform softness and roundness. The ball carcass is an integral hollow ball body, which includes an inner inflatable rubber bladder, a winding thread layer that surrounds the rubber bladder with a reinforcing thread, an outer rubber layer surrounding the winding thread layer in such a manner that the outer rubber layer, the winding thread layer and the rubber bladder are integrally fused into a single fusion layer, wherein the ball carcass further includes a plurality of seam channels integrally and spacedly raised from an outer surface thereof and panels of foaming layer which are positioned between the seam channels and sandwiched between the outer rubber layer and the inner rubber layer fused on top of the winding thread layer.

6 Claims, 5 Drawing Sheets

INFLATABLE SPORTSBALL WITH CUSHION LAYER

CROSS REFERENCE OF RELATED APPLICATION

This application is a divisional application of a non-provisional application, application No. 09/767,310, filed Jan. 22, 2001.

BACKGROUND OF THE PRESENT INVENTION

1. Field of Invention

The present invention relates to an inflatable sportsball, and more particularly to an inflatable sportsball having a cushioned carcass by constructing a cushion layer therein so as to increase the softness of the sportsball land enhancing the roundness of the sportsball.

2. Description of Related Arts

Sportsballs such as basketballs, soccer balls, and footballs conventionally comprise an inflatable bladder and a cover. The inflatable bladder is disposed within the ball cover for propping up the ball after inflation. The inflatable bladder can be made of rubber or polyurethane that can be reinforced with windings of nylon thread or polyester thread. The cover is generally formed from panels of cover material made of rubber, synthetic leather or leather, wherein adjacent panels are separated by rubber channels and portion of the ball excluding the cover is so called the carcass.

In order to improve a player's ability of gripping the sportsball and to reduce the shock of impact, the carcass of the sportsball is made to include cushion material, such as panels of sponge rubber, which are directly adhered on the carcass between the rubber channels. However, the cover panels which cover the cushion material do not adhere well to the cushion material, and the cover panels have a tendency to peel away from the additional cushion material.

U.S. Pat. No. 5,636,835 suggests that after the winding thread layer is attached to the bladder, panels of foamable rubber layer is attached to the winding thread layer. The foamable rubber layers are made from a type of rubber design to foam and create cellular sponge rubber upon application of heat. Consequently, the panels of foamable rubber layers stick directly to the winding thread layer and hold their position prior to placement in a mold. Then, seam channels of unformed seam material are placed over the discontinuities between individual panels of foamable rubber layer, i.e. a rubber layer containing foaming agent.

After the foamable rubber layers and unformed seam channels are in position, the entire arrangement is placed into a carcass-forming mold. In the mold, the carcass is cured under heat in the same way of the conventional ball carcasses. The heat causes the foaming agent within the foamable rubber to expand the panels of foamable rubber layer into a single, uniform cellular sponge layer. The thickness of which is dependent on the space between the outer diameter of the winding thread layer and the inner diameter of the mold and the amount of the out gate created by the foaming agent. The seam channels are molded at the same time, thereby creating the raised seams familiar to conventional basketballs, wherein the sponge layer, which is substantially and directly surrounding the layer of winding, directly underlies the raised seams, and further the inner carcass portion, cellular sponge layer and raised seams together define the ball carcass.

U.S. Pat. No. 5,681,233 suggests that the bladder is inflated and placed in a vulcanizing or curing mold where the bladder is cured by heating. After curing, the inflated bladder is wound with reinforcing thread. Flat sheets or panels of sponge rubber are laid on the wound bladder. The panels of sponge rubber are arranged so that a gap of about 5 mm separates adjacent panels to form a carcass. The carcass is placed in a spherical mold, and the inflated carcass is heat molded at 160° C. During the molding process, a foaming agent in the sponge rubber foams and creates a cellular structure in the foam rubber, which also bonds to the wound bladder, so as to from the ball carcass.

In view of the above conventional arts, a special type of foamable rubber, which is designed to foam, is used to directly stick on the winding thread layer of the inner carcass, wherein such foamable rubber reacts to create the cellular sponge rubber upon application of heat within a kind of close mold. Therefore, the conventional cushioned inflatable ball generally comprises an inflatable bladder and a layer of winding covering the bladder to form an inner carcass defining the shape of the ball, a cellular sponge rubber layer surrounding the inner carcass, and a cover layer surrounding the sponge rubber layer. The cellular sponge rubber layer is formed upon the application of heat within a close type mold, wherein the foamable rubber releases gas upon application of heat to produce a plurality of air meshes and increase the thickness of the rubber to form the cellular sponge rubber so as to achieve the softness feel and effect.

However, there are some drawbacks of the conventional cushioned inflatable balls. Since the foaming process of the sponge rubber is processed in a closed state, that is the foamable rubber is heated inside the press mold in an air tight manner, the gas released from the foamable rubber has no where to escape and no way to be evenly distributed during foaming between the interior surface of the mold and the inner carcass. In other words, it is very difficult to obtain a cellular sponge rubber layer with even thickness. Moreover, the released gas will inwardly press against the inner carcass and force the winding thread to separate from the inflatable blabber, that may affect the roundness of the inflatable ball.

According to both U.S. Pat. Nos. 5,636,835 and 5,681,233, the foaming reaction of the foamable rubber within the close type mold cannot be completely controlled such that the sponge rubber after reaction may not have a uniform thickness, which may affect the softness and the stiffness of the ball. Practically, the conventional cushioned carcass structure provides a great headache to most of the ball manufacturers, that is a large number of manufactured balls will fail the quality test and become defective goods. It not only increases the manufacturing cost unreasonably, but also adversely affects the softness and gripping feel of the balls.

Furthermore, in the U.S. Pat. No. 5,636,835, the thickness the raised channels is reduced by the underlying uniform cellular sponge layer, so that the raised channels are easier worn out that shorter the life span of the ball.

Also, in order to fit different types of playground and different ages of players, different types of sportsball with different levels of softness and stiffness must be made. For example, the sportsball for junior players may have softer ball carcass and the sportsball for professional players may have stiffer ball carcass. So, an alternative is sought for.

SUMMARY OF THE PRESENT INVENTION

A main object of the present invention is to provide an inflatable sportsball which is integrally constructed with a plurality of cushioned portions between the seam channels so as to provide uniform cushion softness for the sportsball.

Another object of the present invention is to provide an inflatable sportsball with cushion layer, which has a softer feeling to reduce the painful during ball passing and catching, especially suitable for children, training players and amateur players.

Another object of the present invention is to provide an inflatable sportsball with cushion layer which can reduce the impact force between the player and the sportsball, so as to prevent an unwanted injure of the player hit by the impact force while receiving the sportsball. Thus, the cushion layer tolerates more impact on the sportsball so as to retain the shape of the sportsball.

Another object of the present invention is to provide a method of manufacturing an inflatable sportsball, which can manufacture a cushioned sportsball in an efficient and economic way and effectively control the softness and roundness of the sportsball.

Another object of the present invention is to provide a method of manufacturing an inflatable sportsball with cushion layer, which can adjust the softness of the sportsball easily. Also, the manufacturing method enables the cushion layers of the sportsball made having a uniform thickness so as to enhance the roundness of the sportsball.

Accordingly, in order to accomplish the above objects, the present invention provides an inflatable sportsball which comprises:

an inflatable ball carcass defining a shape of the sportsball, wherein the ball carcass is an integral hollow ball body, which includes an inner inflatable rubber bladder, a winding thread layer that surrounds the rubber bladder with a reinforcing thread, an outer rubber layer surrounding the winding thread layer in such a manner that the outer rubber layer, the winding thread layer and the rubber bladder are integrally fused into a single fusion layer, wherein the ball carcass further includes a plurality of seam channels integrally and spacedly raised from an outer surface thereof and panels of foaming layer which are positioned between the seam channels and sandwiched between the outer rubber layer and the inner rubber layer fused on top of the winding thread layer; and a ball cover for covering the ball carcass, wherein the ball cover comprises a plurality of skin panels attached to the outer surface of the ball carcass between the seam channels.

DETAILED DESCRIPTION OF THE PREFERRED EMBODIMENT

Figure 1:
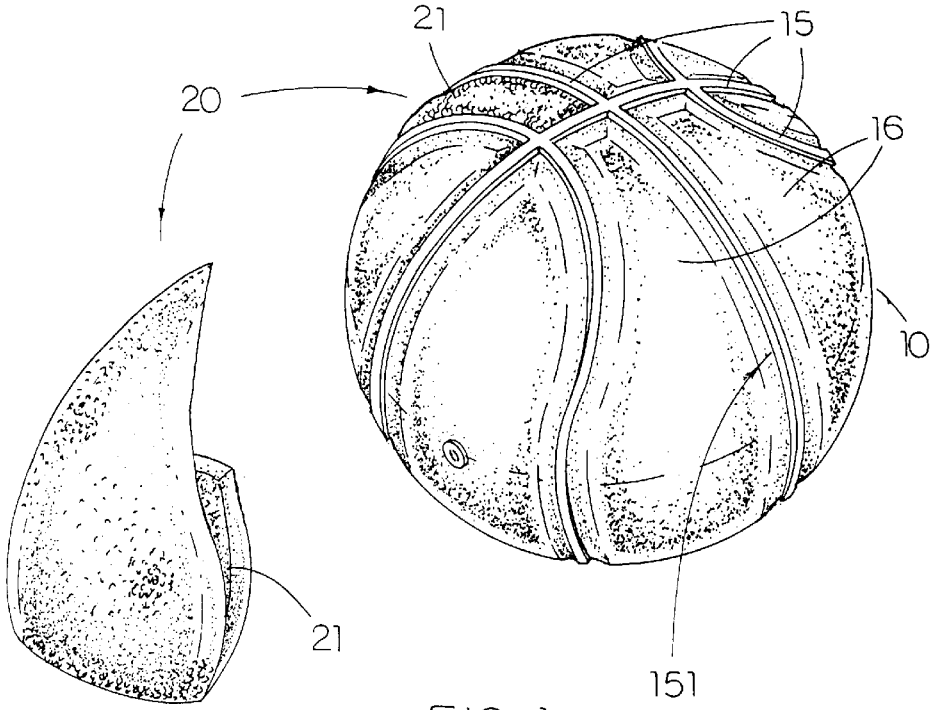
FIG. 1 is a partial exploded perspective view of an inflatable sportsball according to a preferred embodiment of the present invention.

Referring to FIG. 1 of the drawings, the present invention provides an inflatable sportsball which comprises an inflatable ball carcass 10 defining a shape of the sportsball and a ball cover 20 for covering the ball carcass 10, wherein the ball cover 20 comprises a plurality of skin panels 21 attached to the outer surface of the ball carcass 10 between the seam channels 15.

Figure 2:
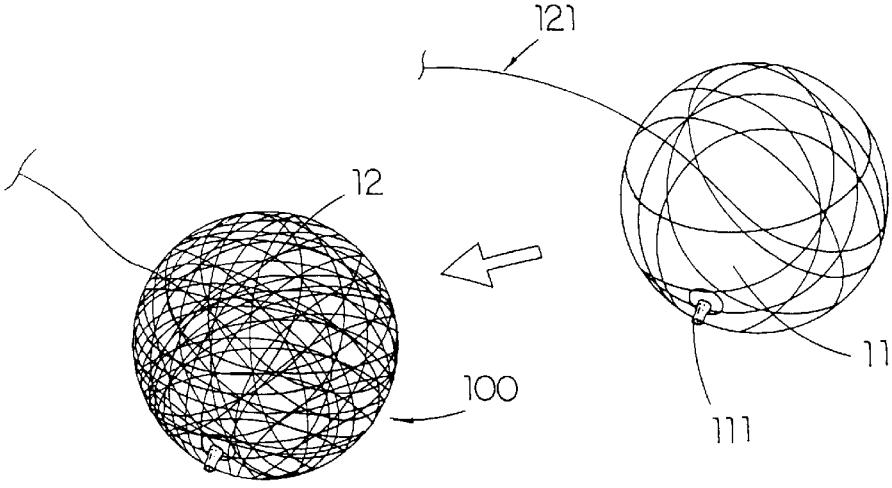
FIG. 2 is a schematic view illustrating the two manufacturing steps of an inner carcass of the inflatable sportsball according to the above preferred embodiment of the present invention.
Figure 3A:
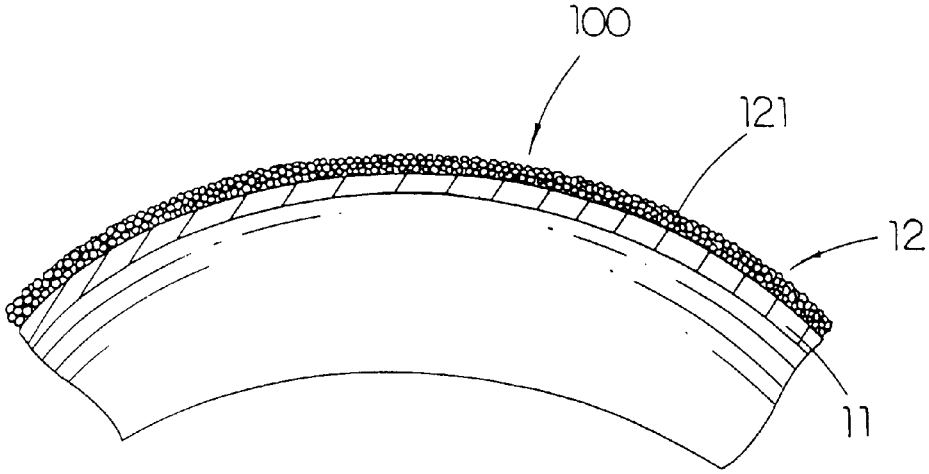
FIG. 3A is a partial sectional view of the inner carcass of the inflatable sportsball according to the above preferred embodiment of the present invention.
Figure 3B:
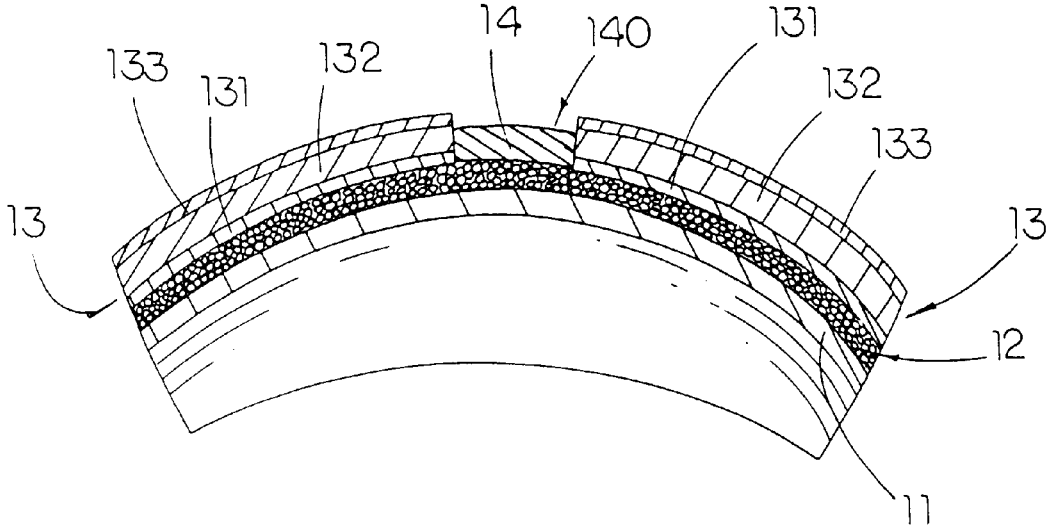
FIG. 3B is a partial sectional view of the inner carcass having panels of cushion layer and rubber strip attached thereon according to the above preferred embodiment of the present invention.
Figure 3C:
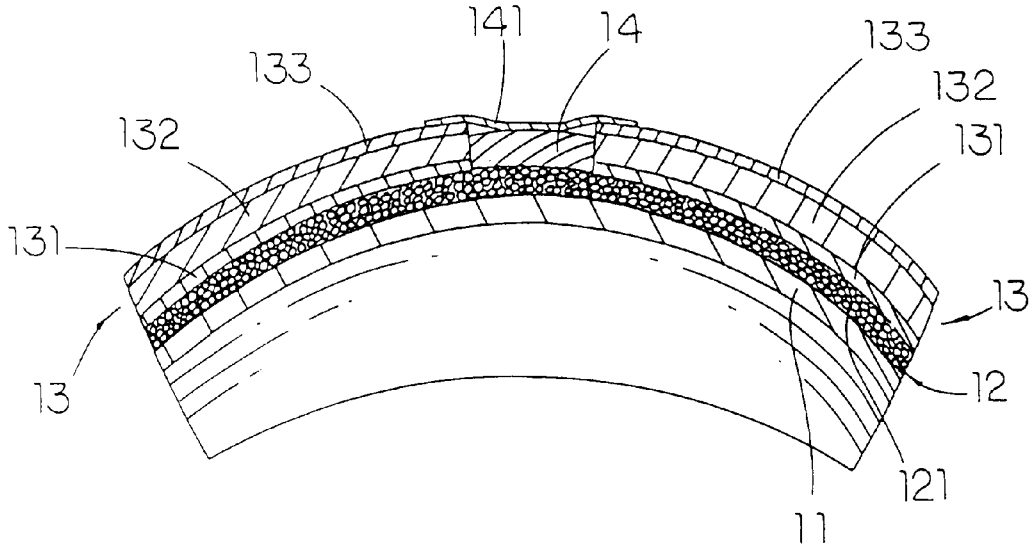
FIG. 3C is a partial sectional view of a semi-finished ball carcass of the inflatable sportsball according to the above preferred embodiment of the present invention.
Figure 4:
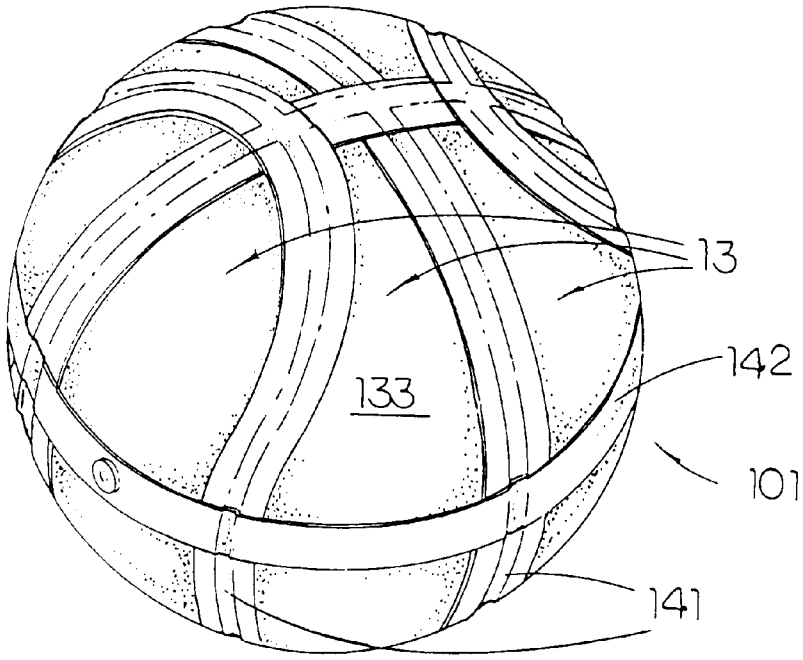
FIG. 4 is a perspective of the semi-finished ball carcass of the inflatable sportsball according to the above preferred embodiment of the present invention.

Referring to FIGS. 2 to 4, according to the preferred embodiment of the present invention, the sportsball is embodied as a basketball, wherein the ball carcass 10 is a cushioned ball carcass manufacturing by an innovative method.

As shown in FIGS. 2 and 3A, in order to make the ball carcass 10, an inflatable rubber bladder 11 is inflated through a valve stem 111 provided thereon. The inflated rubber bladder 11 is wound with reinforcing thread 121 such as nylon thread which forms a winding thread layer 12 surrounding the rubber bladder 11 so as to form an inner carcass 100.

Figure 7:
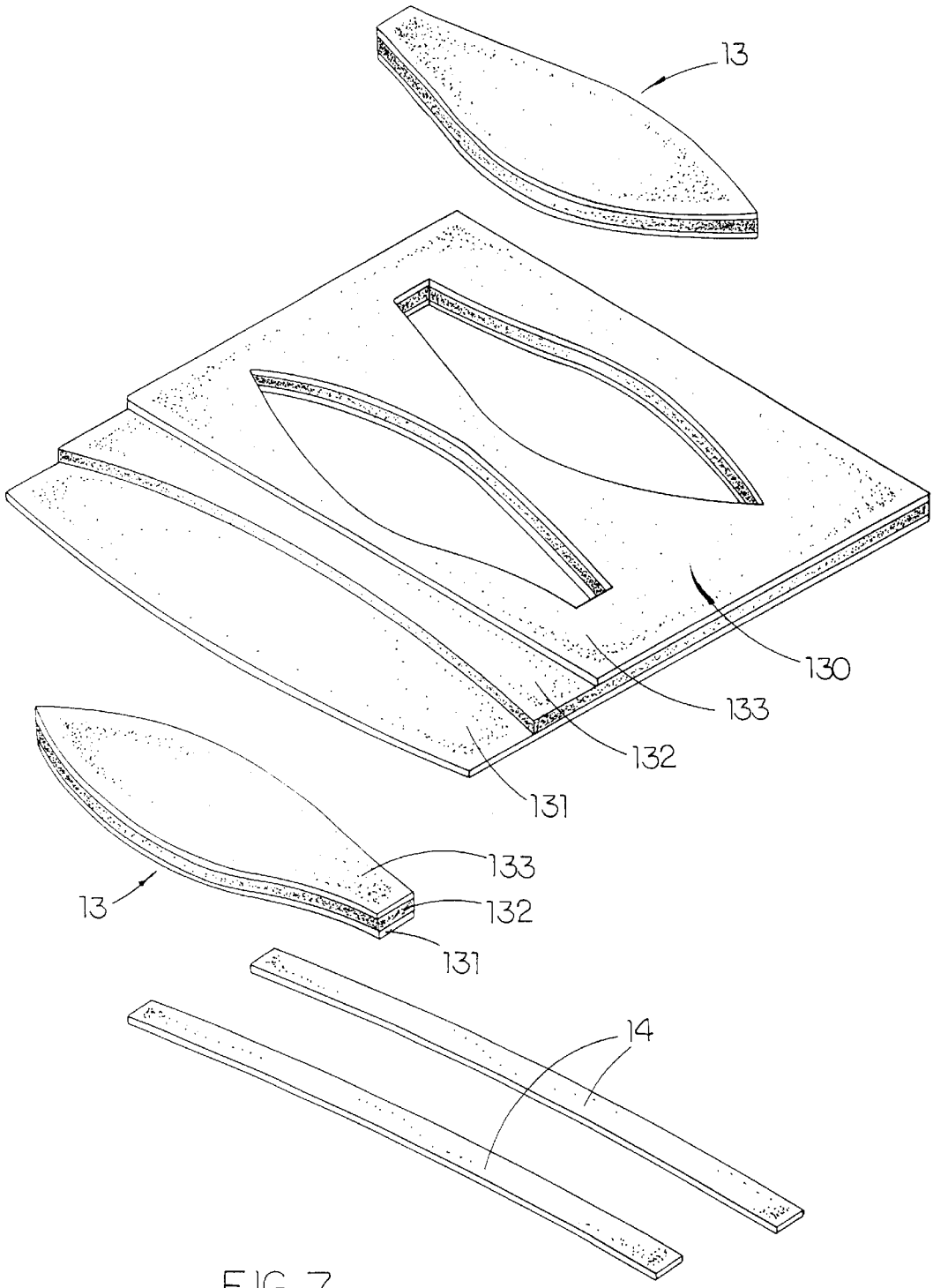
FIG. 7 is a perspective view illustrating the formation of the cushion layers and rubber strips according to the above preferred embodiment of the present invention.

As shown in FIG. 7, a plurality of cushion panels 13 are provided by cutting from a large piece of laminated cushion layer 130 which comprises a thin inner rubber layer 131, a foaming layer 132 firmly adhered on the inner rubber layer 131, and a thin outer rubber layer 133 firmly adhered on the foaming layer 132. The inner rubber layer 131 and the outer rubber layer 133 are preferred to have a thickness of less than 1 mm and the foaming layer 132 is preferred to have a thickness of 1 mm to 2 mm. The foaming layer 132 is made of foaming material such as EVA and sponge rubber which is made by heating a kind of rubber contained foaming agent inside a mold. In order words, the cushion panel 13 contains no foaming agent and will not generate gas upon heating.

When sponge rubber is used as the foaming material, the manufacturer will first to adhere the inner rubber layer 131 and the outer rubber layer 133 on both side surfaces of a foaming rubber 132 containing foaming agent. Then, the foaming rubber 132 with the inner and outer rubber layers 131, 133 adhered thereon are placed in a plate mold and heats to a predetermined temperature. When the plate mold is opened, the gas released during the foaming process emits to the air so as to produce the foaming layer 132 with uniform thickness and even softness.

Each of the cushion panels 13 is cut to a predetermined shape. The cushion panels 13 are adhered on the winding thread layer 12 of the inner carcass 100 and arranged so that a gap 140 of 10 mm to 15 mm separates adjacent cushion panels 13, as shown in FIG. 3B.

As shown in FIGS. 7 and 3B, a plurality of rubber strips 14 each has a predetermined width fittingly to fill the gap 140 separating adjacent cushion panels 13 and a thickness thinner than the cushion panel 13, i.e. about 1 mm. In other words, each rubber strip 14, which is made of general rubber material containing no foaming agent, is thicker than the inner rubber layer 131 of the cushion panel 13. The rubber strips 14 are adhered along the gaps 140 formed between the sides of the cushion panels 13. So that, as shown in FIG. 3B, all the cushion panels 13 and the rubber strips 14 are arranged edge by edge to completely cover the inner carcass 100.

As shown in FIGS. 3C and 4, an elongated rubber film 141 having a thin thickness thinner than the outer rubber layer 133 of the cushion panel 13 and a width wider than the gap 140 and the rubber strips 14. The rubber film 141 is adhered along the rubber strips 14, wherein two side edges of the rubber film 141 are arranged to stick along the side portions of the two adjacent cushion panels 13 so as to completely cover any possible clearance occurred between the rubber strip 14 and the adjacent cushion panels 13. Therefore, a semi-finished ball carcass 101 is formed as shown in FIG. 4.

In order to better shaping the roundness of the sportsball, an additional strip of rubber film 142 is preferred to stick around the semi-finished ball carcass 101 in such a manner that the rubber film 142 can extend across all the rubber strips 14.

Figure 5:
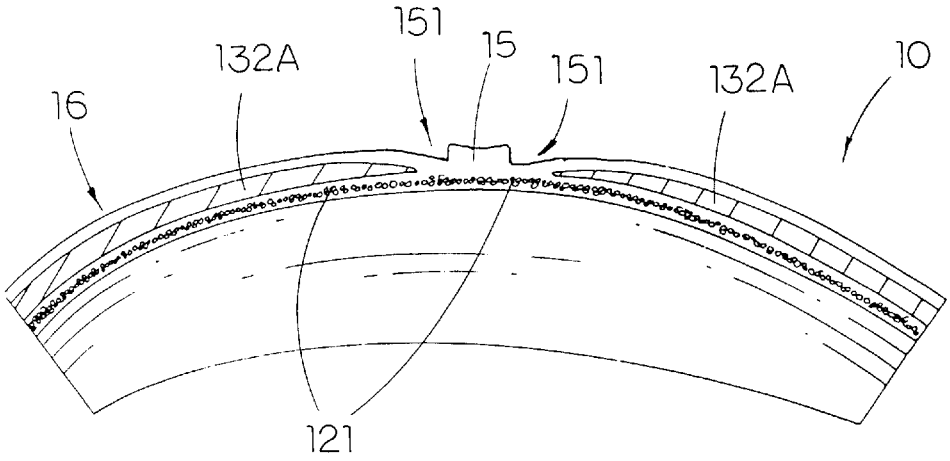
FIG. 5 is a partial sectional view of a ball carcass of the inflatable sportsball according to the above preferred embodiment of the present invention.

The semi-finished ball carcass 101 is then placed in a spherical mold and the inflated semi-finished ball carcass 101 is heat molded to a predetermined temperature, such as 160° C. During the molding process, under each of the cushion panels 13, the inner rubber layer 131 of the cushion panel 13 melts into the winding threads 121 of the winding thread layer 12 and fuses to the rubber bladder 11 integrally, as shown in FIG. 5. Moreover, along the rubber strips 14, the rubber film 142, the rubber strips 14, and the inner rubber layers 131 of the adjacent cushion panels 13 melt into the winding threads 121 of the winding thread layer 12 and fuse to the rubber bladder 11 to form the ball carcass 10 as shown in FIG. 1.

Accordingly, referring to FIGS. 1 and 5, after the heat molding process, the semi-finished ball carcass 101 is fused into an integral hollow ball body to form the inflatable ball carcass 10. In other words, all the rubber materials, including the rubber film 142, the rubber strips 14, the inner rubber layers 131, and the outer rubber layers 133 are fused into a single fusion layer of the ball carcass 10. According to the preferred embodiment, in order to produce a basketball as the sportsball, along the gaps 14 positioned between the cushion panels 13, no foaming material is contained. The mold is designed to fuse and shape the rubber strips 14 into the plurality of seam channels 15 integrally and spacedly raised from an outer surface of the ball carcass 10. At the same time, as shown in FIG. 5, the foaming layer 132 of each of the cushion panels 13 is embedded in the ball carcass 10 to form a plurality of foaming panels 132A sandwiched between the outer rubber layer 133 and the winding thread layer 12 and positioned between the seam channels 15. Therefore, the portions spaced between the seam channels 15 become cushioned carcass portions 16 that provide the softness feel of the sportsball, improve a player's ability to grip the sportsball and reduce the shock of impact.

Figure 6:
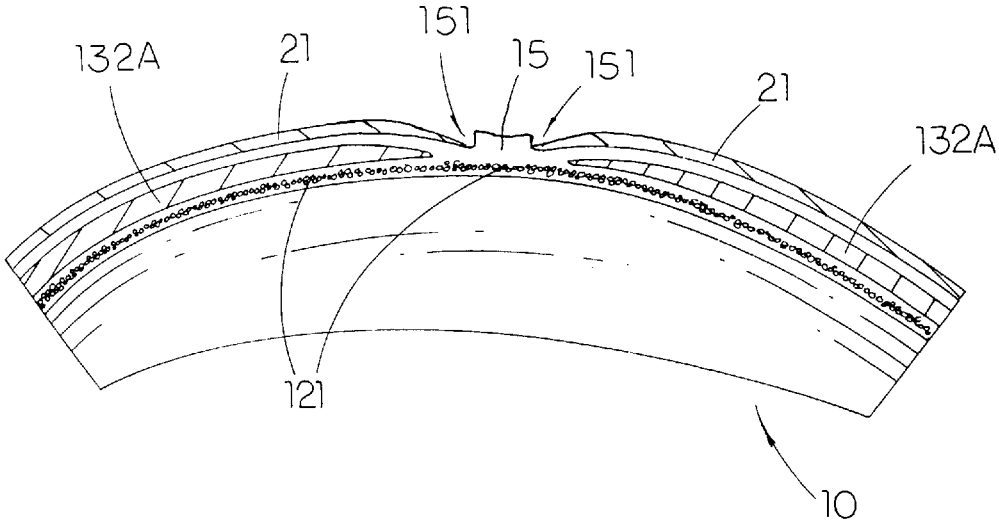
FIG. 6 is a partial sectional view of the inflatable sportsball according to the above preferred embodiment of the present invention.

As shown FIGS. 5 and 6, along both sides of each of the seam channels 15, indention grooves 151 ,are formed to provide the pop-up shape of the cushioned carcass portions 16. Finally, as shown in FIG. 6, the skin panels 21 are adhered on the cushioned carcass portions 16 respectively to form the sportsball.

In view of above, the inflatable sportsball according to the present invention can achieve the following advantages:

(a) The even softness and uniform thickness of the foaming layers 132 provide a better soft feel to grip. Moreover, the manufacturer can control the softness of the sportsball simply by adjusting the thickness of the foaming layer 132 of the cushion panel 13.

(b) Since there is no gas released during the heat molding process of the sportsball, the problem of inverse gas pressure that may separate the winding thread from the bladder can thus be eliminated.

(c) The integral structure provides a durable construction for the sportsball that can better resist impact. Moreover, no foaming material underlies the seam channels to prevent the conventional problem of that the seam channels are easy worn out.

(d) The manufacturing process is simple and efficient because no calculation or measurement of the amount of gas will be released during the heat molding process.

(e) For the ball carcass, the cushioned carcass portions 16 are raised higher than the seam channels 15, which enable the players' ability of gripping the sportsball easily and firmly.

What is claimed is:

1. An inflatable sportsball, comprising:

an inflatable ball carcass defining a shape of said sportsball, wherein said ball carcass is an integral hollow ball body, which includes an inflatable rubber bladder, a winding thread layer that surrounds said rubber bladder by winding said inner rubber bladder with a reinforcing thread and an inner rubber layer surrounding said winding thread layer in such a manner that said inner rubber layer, said winding thread layer and said inflatable rubber bladder are integrally fused into a single fusion body, wherein said ball carcass further includes an outer layer integrally surrounding said single fusion body and having a plurality of seam channels integrally and spacedly raised from an outer surface thereof, and panels of foaming layer which are positioned between said seam channels and sandwiched between said outer rubber layer and said inner rubber layer fused on top of said winding thread layer; and a ball cover for covering said ball carcass, wherein said ball cover comprises a plurality of skin panels attached to said outer surface of said ball carcass between said seam channels.

2. The inflatable sportsball, as recited in claim 1, wherein portions spaced between said seam channels form cushioned carcass portions and, along both sides of each of said seam channels, indention grooves are formed to provide a pop-up shape for each of said cushioned carcass portions.

3. The inflatable sportsball, as recited in claim 1, wherein said panels of foaming layer are made of sponge rubber which is made by heating a kind of rubber contained foaming agent inside a mold.

4. The inflatable sportsball, as recited in claim 2, wherein said panels of foaming layer are made of sponge rubber which is made by heating a kind of rubber contained foaming agent inside a mold.

5. The inflatable sportsball, as recited in claim 3, wherein said sponge rubber is made by adhering said inner rubber layer and said outer rubber layer on both side surfaces of a foaming rubber containing a foaming agent, and then heating said foaming rubber with said inner and outer rubber layers adhered thereon in a plate mold until gas is released from said foaming rubber to produce air meshes and increase thickness to form said sponge rubber with uniform thickness and even softness.

6. The inflatable sportsball, as recited in claim 4, wherein said sponge rubber is made by adhering said inner rubber layer and said outer rubber layer on both side surfaces of a foaming rubber containing a foaming agent, and then heating said foaming rubber with said inner and outer rubber layers adhered thereon in a plate mold until gas is released from said foaming rubber to produce air meshes and increase thickness to form said sponge rubber with uniform thickness and even softness.

* * * * *